US007316503B2

(12) United States Patent
Mathys et al.

(10) Patent No.: US 7,316,503 B2
(45) Date of Patent: Jan. 8, 2008

(54) STATIC MIXER

(75) Inventors: Peter Mathys, Neuhausen (CH); Robert Schaetti, Winterthur (CH); Zdravko Mandic, Winterthur (CH)

(73) Assignee: Sulzer Chemtech AG, Winterthur (CH)

( * ) Notice: Subject to any disclaimer, the term of this patent is extended or adjusted under 35 U.S.C. 154(b) by 526 days.

(21) Appl. No.: 10/832,881

(22) Filed: Apr. 27, 2004

(65) Prior Publication Data

US 2004/0223408 A1 Nov. 11, 2004

(30) Foreign Application Priority Data

May 8, 2003 (EP) ..... 03405324

(51) Int. Cl.
*B01F 5/06* (2006.01)

(52) U.S. Cl. ..... 366/337

(58) Field of Classification Search ..... 366/336, 366/337

See application file for complete search history.

(56) References Cited

U.S. PATENT DOCUMENTS 2,426,833 A * 9/1947 Lloyd ..... 366/336
4,123,178 A 10/1978 Salzman et al. ..... 366/338
4,710,326 A * 12/1987 Seah ..... 261/112.2
4,758,098 A * 7/1988 Meyer ..... 366/337
4,899,812 A 2/1990 Altoz ..... 165/109.1
6,394,644 B1 * 5/2002 Streiff ..... 366/337
6,409,378 B1 * 6/2002 Kessler ..... 366/337
6,811,302 B2 * 11/2004 Fleischli et al. ..... 366/337

FOREIGN PATENT DOCUMENTS

DE 213602 9/1984
GB 2032791 5/1980

* cited by examiner

*Primary Examiner*—Tony G. Soohoo
(74) *Attorney, Agent, or Firm*—Francis C. Hand; Carella, Byrne, Bain et al.

(57) ABSTRACT

The static mixer for a low viscosity fluid contains inbuilt devices effective for mixing, which are arranged in a pipe or in a container conducting the fluid. The inbuilt devices include structure elements in the form of flat, folded or curved sheet metal-like flow obstacles to form primary flow obstacles to achieve a flow of the first order. The structure elements are geometrically modified at surfaces and/or at edges so that local flows of the second order can be induced which are superimposed on the flow of the first order and so improve the mixing quality. Radial and axial inhomogeneities in the fluid are namely better compensated than by the flow of the first order.

18 Claims, 3 Drawing Sheets

STATIC MIXER

This invention relates to a static mixer. More particularly, this invention relates to a static mixer having a mixing device for a low viscosity fluid.

The development of static mixers has resulted in a very large diversity of mixing devices. As is known, a very large number of solutions can be realised depending on the mixing desired, in accordance with which a specific mix quality has to be achieved at a pre-determined, maximum permissible pressure loss. These solutions, however, differ quite considerably in construction and the differences in construction have effects on the manufacturing costs and also on the costs for the inbuilt device of the mixer in a plant.

Mixing devices are preferred which satisfy the mixing object with simple inbuilt devices and simultaneously with a minimum number of structure elements of the inbuilt devices. Such mixing devices, which will probably establish themselves more and more, have a short inbuilt device length (inbuilt device length=length in a pipeline which has to be provided for the inbuilt devices); and they moreover require a short mixing path (i.e., the distance from the infeed point of an additive up to the position in the pipeline where the required mixing quality is achieved).

Solutions are also known for the mixing of a fluid in a turbulent flow region in which a pipeline contains a structure that consists only of one single, short mixing element, i.e. of a minimum number of structure elements of the inbuilt devices (see e.g. U.S. Pat. No. 5,839,828). Such a solution is optimum to the extent it relates to the inbuilt device length of the structure. It has, however, been found that these known structures, including in each case only one mixing element, have to be improved due to substantial deficiencies.

There are structures in which the short inbuilt device length is associated with a large pressure drop and/or with a long mixing path. A further problem, which was surprisingly found, is the following: the inbuilt devices of known static mixers are flow obstacles around which fluid flows and by which the fluid is set into vortex movements. Vortices with a specific frequency separate off in the wake of each obstacle. A similar phenomenon can be observed with a cylinder that is flowed around in the form of "Karman's vortex channel".

In static mixers, the vortex movements, as a rule, form a substantially more complicated process. However, the periodicity of the process is common with "Karman's vortex channel". The vortex spheres which periodically separate off at the obstacles are carried along by the flow at axial, constant intervals. Any additive added to the mixer is taken up by the separating vortices and carried onward in the pipe with the vortices. Thus, inhomogeneities arise in the form of axial concentration differences, which appear as periodic fluctuations in the pipe at fixed observation positions. This time phenomenon can clearly be found in the mixer, which is described, in the aforesaid U.S. Pat. No. 5,839,828.

Corresponding inhomogeneities also occur in a mixer which is known from EP-A-1 153 650.

Usually, the mixing quality of a static mixer is understood as a measure for the homogenisation, which relates to the radial concentration distribution. The smaller the inhomogeneities of this radial distribution are, the better the mixing quality is. The inhomogeneities present due to the axial concentration gradients can, however, have the same order of magnitude as the inhomogeneities with respect to the radial concentration distributions. This was determined using a measurement process in which the mixing quality was detected at a high frequency (20 measurements per second). In some applications, these axial inhomogeneities or time fluctuations can be of substantial importance, for example, on a fast chemical reaction between the components to be mixed, or for a regulation of the transport speed of an additive which was carried out with respect to the concentrations measured in the pipe.

Accordingly, it is an object of the invention to provide a static mixer which does not have the disadvantages with respect to axial inhomogeneities when a single mixing element is used or with a minimum number of structure elements of the inbuilt devices.

It is another object of the invention to ensure a high quality of a mixture despite low inbuilt device costs.

It is another object of the invention to improve the mixing characteristics of a static mixer for a low viscosity fluid.

Briefly, the invention provides a static mixer for a low viscosity fluid that contains a mixing device that is effective for mixing arranged in a pipe or in a container conducting the fluid.

The mixing device includes inbuilt devices, the geometry of which is largely that of a base structure. The inbuilt devices include structure elements in the form of flat, folded or curved sheet metal-like flow obstacles that form constrictions in the flow path of a fluid. A flow of the first order can be achieved by inbuilt devices in the form of the base structure and is a flow which mixes the pipe contents globally in downstream mixing regions. The structure elements of the base structure can be described as segments, webs, plates and/or vanes. The structure elements—called "primary flow obstacles" in the following—are geometrically modified on surfaces and/or at edges. Local flows of the second order can be induced by these modifications and are superimposed on the flow of the first order and thus improve the mixing quality. Radial and axial inhomogeneities in the fluid are namely compensated better than by the flow of the first order. Secondary flow obstacles form the modifications by which the turbulence is locally intensified and/or backflows are induced.

In one embodiment, the mixing device comprises a plurality of primary flow obstacles that are disposed to define constrictions for a flow of viscous fluid and to impart a flow of a first order in the flow of viscous fluid passing through the constrictions. Each primary flow obstacle has a geometrically modified area at a surface thereof and/or an edge thereof to induce local flows of a second order in the flow of viscous fluid passing thereover whereby these local flows of second order are superimposed on the flows of the first order to compensate radial and axial inhomogeneities in the viscous fluid produced by the flow of the first order.

Each primary flow obstacle is in the form of at least one of a flat, folded and curved sheet material and each has a secondary flow obstacle thereon defining the geometrically modified area thereof.

Each secondary flow obstacle may be in the form of a rib disposed transversely to a respective local flow.

In another embodiment, each primary flow obstacle is in the form of a crossed channel structure having a plurality of sheets of metal folded in a zigzag manner and each secondary flow obstacle is a rib or a rod disposed on the respective crossed channel structure.

In other embodiments, the secondary flow obstacle may be a rib having sharp edges and may be disposed as a folded edge of a primary flow obstacle.

In another embodiment, the secondary flow obstacle may have one of a wave-like edge and a toothed edge and may be disposed at an edge of a primary flow obstacle.

These and other objects and advantages of the invention will be more apparent from the following detailed description taken in conjunction with the accompanying drawings wherein.

Figure 1:
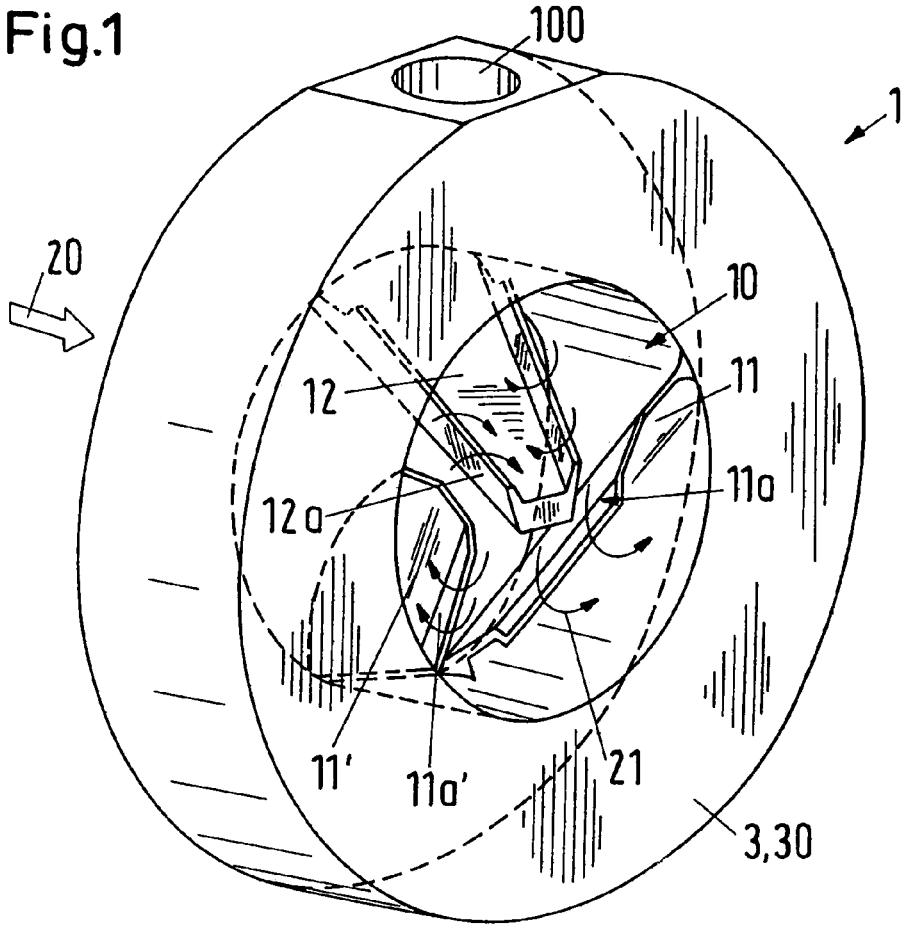
FIG. 1 illustrates a ring-shaped part of a mixer in accordance with the invention having inbuilt devices whose structure elements have lamella-like secondary flow obstacles.

Referring to FIG. 1, the mixing device 1 is constructed to be used for homogenisation of a low viscosity fluid 20 and consists of a section of a pipe 3 and of inbuilt devices 10 effective for mixing which are arranged in the pipe 3. Only a ring-like part 30 of the pipe 3 is illustrated. This part 30 is installed at a flange transition of the pipe 3 (not shown). The inbuilt devices 10 effective for mixing of this embodiment can also be arranged in a pipe 3 at a position, which is not made as a flange transition.

The geometry of the inbuilt devices 10 is largely that of a base structure that has structure elements 11, 11' and 12 in the form of segment-like or vane-like flow obstacles. The fluid 20, whose flow is indicated by arrows 21, flows through constrictions lying between the structure elements. The structure elements of the base structure, which can be described as segments, webs, plates and/or vanes, are called "primary flow obstacles" in the following. These primary flow obstacles 11, 11' and 12 are modified geometrically at the edges, namely by secondary flow obstacles 11*a*, 11*a*' and 12*a* which are lamella-like in the embodiment in FIG. 1.

A flow of the first order, which is a flow which globally mixes the pipe contents in downstream mixing regions, results as a consequence of the inbuilt devices 10, which are made in the form of the base structure. A mixing over the whole pipe cross-section takes place in these regions by extensive movements, in particular by periodically separating and propagating vortex movements. Local flows of the second order are induced on the basis of the modifications of the base structure by means of the secondary flow obstacles and positively influence the effectiveness of the mixing process by the following effects:

a) the degree of turbulence of the flow is increased by the modification.

As has already been observed with known mixers, the mixing quality improves when the flow at the inlet side has a high turbulence. Such an increased turbulence can, for example, be the consequence of a means, such as, a manifold with deflector plates disposed upstream. A similar or even more positive effect can be achieved when the degree of turbulence is directly increased locally in the mixer itself by secondary flow obstacles. The obstacles are particularly effective when they are arranged in the proximity of the position where the additive is added. The concentration gradients are still comparatively highly pronounced there and an improvement of the mixing effect in these regions has a particularly positive effect on the effectiveness of the mixer.

b) Backflows can be directly produced with the aid of the secondary flow obstacles 11*a*, 11'*a* and 12*a* in which an additive is diluted before being washed out and carried away in the separating vortices.

The temporary concentration fluctuations are thereby reduced. Generally, axial differences can be compensated by backflows, also those which are caused by a non time-constant addition of the components to be mixed.

c) The secondary flow obstacles 12*a* bring about a channelling of the flow.

The transverse transport behind the central vane 12 is thereby improved, whereby the radial degrees of concentration in the wake of the inbuilt devices 10 are reduced.

d) The flow is also stabilised, i.e. fluctuations are suppressed, by the amplified turbulence and increased turbulent viscosity caused thereby.

The secondary flow obstacles 11*a*, 11*a*' and 12*a* are also advantageously arranged and designed such that the breakaway is clearly localised and thus does not depend on the Reynolds number. The strength of the flow is thus not dependent on the flow amount and is easier to control.

The combination of these effects a) to d) results in an improved radial and axial homogenisation.

The secondary flow obstacles 11*a*, 11*a*' and 12*a* admittedly increase the pressure loss. However, the pressure loss increase is smaller than if instead additional primary flow obstacles were used in accordance with the obstacles 11, 11' and 12—that is additional mixing elements. These would be necessary if the secondary flow obstacles 11*a*, 11*a*' and 12*a* were omitted. The secondary obstacles are thus also to be evaluated positively with respect to the use of energy. The primary flow obstacles 11, 11', 12 are therefore geometrically modified at surfaces and/or at edges by the secondary flow obstacles 11*a*, 11'*a* and 12*a* such that local flows of the second order can be induced by these modifications which are superimposed on the flow of the first order and thus improve the mixing quality. The mixing quality is improved in that radial and axial inhomogeneities in the fluid are compensated better than by the flow of the first order, without an increase in the pressure drop simultaneously resulting of more than approximately 100%.

The secondary flow obstacles 11*a*, 11'*a* and 12*a* are arranged at edge regions of the primary flow obstacles 11, 11' and 12. They thus form modifications of the primary flow obstacles 11, 11' and 12 and locally intensify the turbulence and/or induce backflows of the fluid 20, whereby the mixing is improved.

The secondary flow obstacles 11*a*, 11'*a* and 12*a* are advantageously made in lamellar or rib shape and are arranged transversely to the local flow direction of the flow of the first order at or on the primary flow obstacles.

A main flow direction (arrow 20) is defined perpendicular to the pipe cross-section by the pipe 3. The pipe cross-section is largely completely covered by a normal projection of the primary flow obstacles 11, 11' and 12 in the main flow direction. As a consequence of the requirement that the inbuilt devices effective for mixing should include a minimum number of structure elements, the pipe cross-section is not further covered by the normal projections of the individual flow obstacles 11, 11' and 12; or the projection only has marginal overlapping zones.

With the embodiment of FIG. 1, the pipe 3 is cylindrical and the primary flow obstacles 11, 11' and 12 form a mirror-symmetrical arrangement with a plane of symmetry in which the axis of the pipe lies. The pair 11, 11' of segment-shaped structure elements lying largely in a common plane form a constriction within which the vane-like or web-like structure element 12 is arranged crossing the plane of the two other structure elements 11, 11'.

Figure 2:
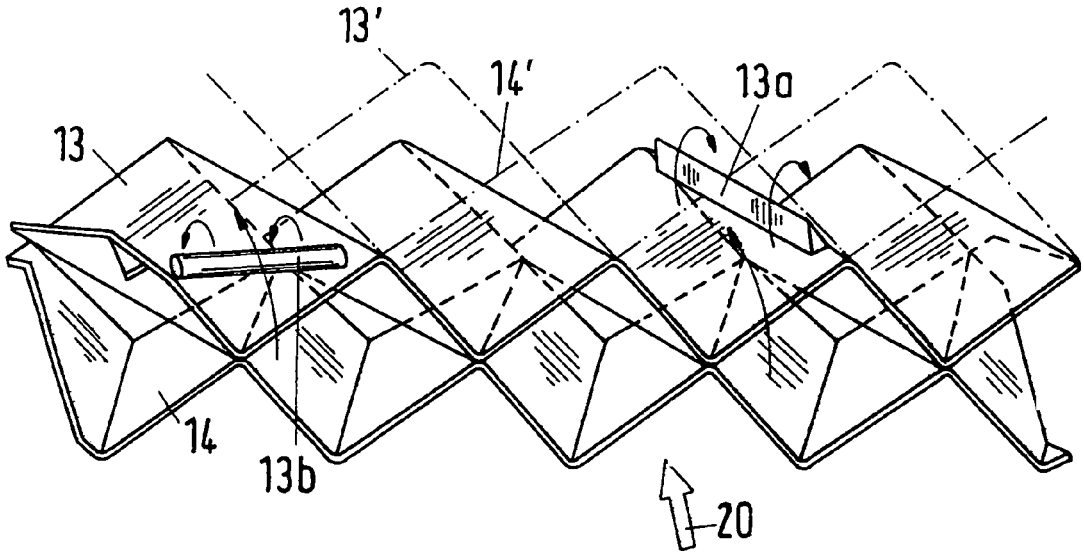
FIG. 2 illustrates a crossed channel structure with two further examples of secondary flow obstacles.

With the inbuilt device 10 shown in FIG. 2, the basic structure is a crossed channel structure in which a plurality of metal sheets 13, 14 folded in a zigzag manner (and metal sheets 13', 14' indicated by chain dotting) form the primary flow obstacles. Ribs 13*a* and/or wire-like elevations 13*b* are arranged on the sheet metal surfaces of the crossed channel structure to form the secondary flow obstacles. Only one example each is shown of these secondary flow obstacles 13*a*, 13*b*. The ribs 13*a* are advantageously made with sharp edges and serve as breakaway edges at the folded edges over which flow occurs.

Figure 4:
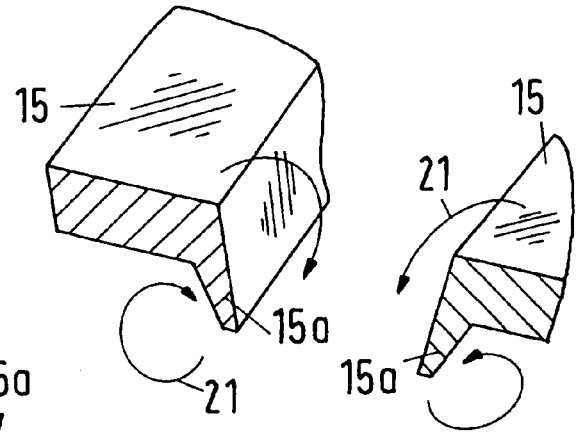
FIG. 4 illustrates a detail of the structure of FIG. 3.
Figure 3:
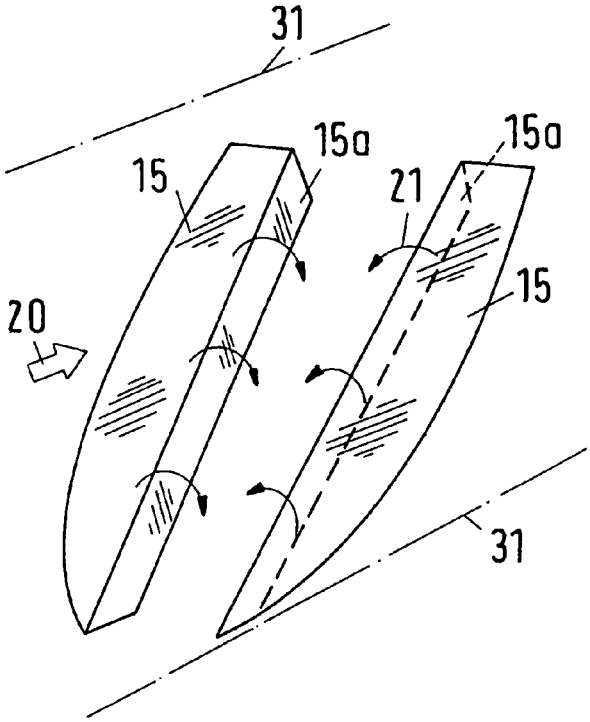
FIG. 3 illustrates inbuilt devices of a mixer in accordance with the invention with two segment-like structure elements.

FIG. 3 shows inbuilt devices 10 of a mixing device 1 having two segment-like structure elements 15. The secondary flow obstacles 15*a* of the structure elements 15 are of lamellar shape. The inside of the pipe 3 is indicated by the chain dotted lines 31. A cross-section through the structure element 15 is shown in FIG. 4. The manner in which backflows form behind the structure elements 15 is indicated by the arrows 21.

Figure 5:
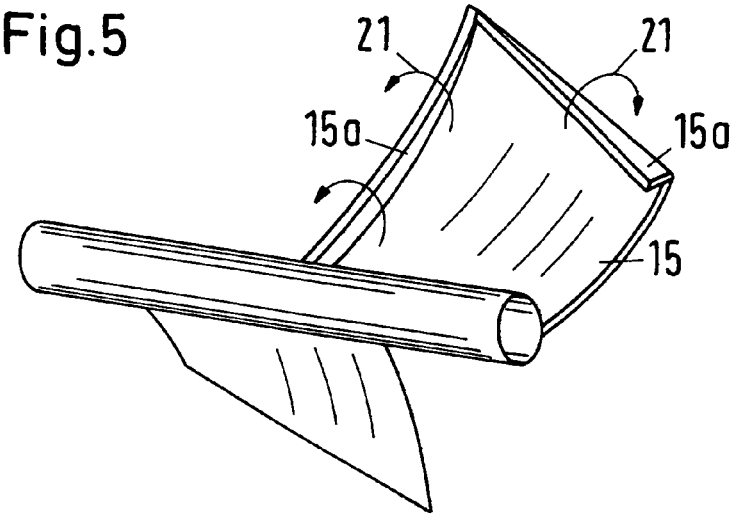
FIG. 5 illustrates an inbuilt device having two guide vanes as structure elements.

FIG. 5 shows a built-in device having two guide vanes 15 as structure elements. With the one of the guide vanes 15, secondary flow obstacles 15*a* are shown.

Figure 6:
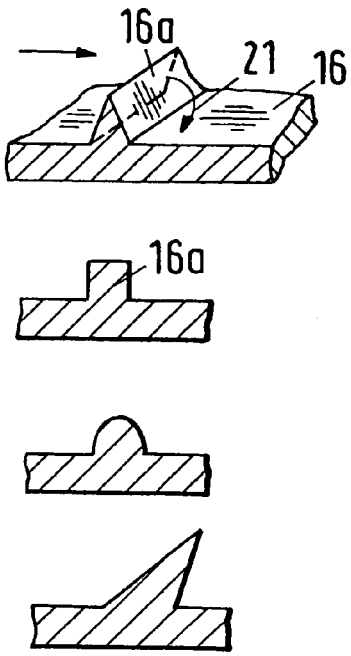
FIG. 6 illustrates secondary flow obstacles (four part figures) which are of rib shape and are arranged on a surface of a primary flow obstacle over which flow occurs.

In FIG. 6, secondary flow obstacles 16*a* are shown in four part figures; in the first as a perspective representation and in the further part figures only as cross-section profiles. These obstacles 16*a* are of rib shape and are arranged on a surface of a primary flow obstacle 16 over which flow occurs.

Figure 7:
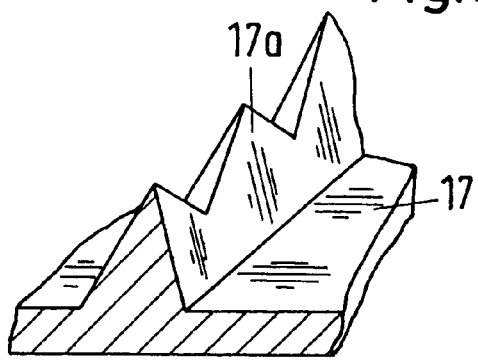
FIG. 7 illustrates a secondary flow obstacle in the form of a linear element with toothed edges.
Figure 8:
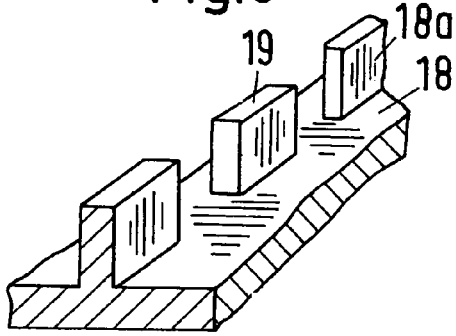
FIG. 8 illustrates a secondary flow obstacle in the form of a linear element with spaced apart teeth.
Figure 9:
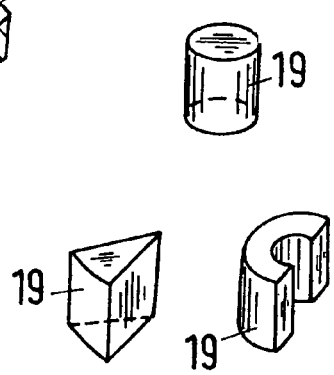
FIG. 9 illustrates various tooth shapes (three part figures) in accordance with the invention.

FIGS. 7 and 8 show secondary flow obstacles 17*a* and 18*a* which form linear elements one with a toothed edge and one with separate teeth 19. Examples for other forms of the teeth 19 are shown in three part figures of FIG. 9. The linear element 17*a* can also have a wave-shaped edge instead of a toothed edge. Such a geometrical modification at the edge of the primary flow obstacle results in an extension of the edge, which advantageously has the consequence of a strengthened forming of turbulence.

Figure 10:
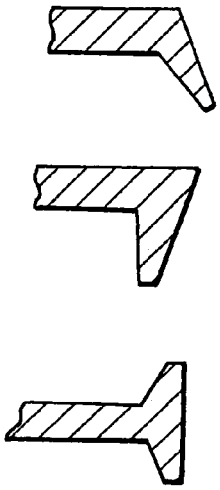
FIG. 10 illustrates milled secondary flow obstacles (three part figures) which are arranged in the form of linear elements at an edge of the primary flow obstacle in accordance with the invention.

FIG. 10 shows milled secondary flow obstacles (three part figures) which are arranged in the form of linear elements at an edge of the primary flow obstacle.

Figure 11:
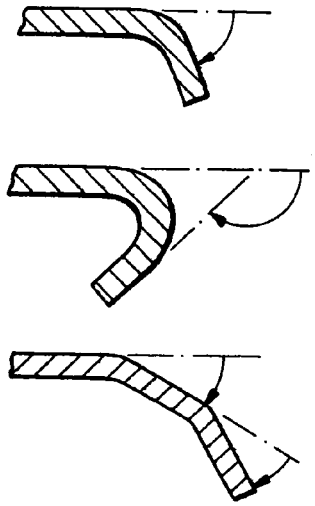
FIG. 11 illustrates secondary flow obstacles (three part figures) which are each produced on primary flow obstacles by bending the edges in accordance with the invention.

FIG. 11 shows secondary flow obstacles, which are each, established by reshaping the rim of the primary flow obstacle: slightly bent (first part figure), strongly bent (second part figure) and bent twice (third part figure), as is indicated by arrows in each case. Similar shapes of secondary flow obstacles can also be realised by using sheet metal strips on the primary flow obstacles.

The embodiment of FIG. 1 contains an infeed point 100 for additives in the pipe piece 30. The infeed point 100 advantageously opens into a zone of the mixing regions in which the influence of the geometrical modifications on the flow is particularly strong. A plurality of infeed points 100 can also be provided. More advantageous, however, is a single infeed point 100, which can thus be ideally arranged with respect to the inbuilt devices 10. Experience has shown that a plurality of infeed points 100 for a single additive is associated with problems, which do not occur with a single infeed point 100.

The mixing device 1 is used for the carrying out of a mixing process in which the fluid 20 to be mixed is transported through the mixing device 1 in a preferred direction. A better mixing quality is achieved with respect to this preferred direction than in the opposite direction.

As has already been mentioned, the mixing quality improves when the flow at the inlet side is turbulent. It can therefore be advantageous for the mixing method in accordance with the invention, if the fluid 20 is brought into a hydrodynamic state in which it has turbulent flow components or a stronger turbulence before being is led into the inbuilt devices 10 effective for mixing.

The invention thus provides a mixing device that can be made economically and that can be used to achieve greater homogenisation of a low viscosity fluid than previously known mixing devices.

What is claimed is:

1. A mixing device for a static mixer comprising a plurality of primary flow obstacles disposed to define constrictions there-between for a flow of viscous fluid therethrough and to impart a flow of a first order in the flow of viscous fluid passing through said constrictions including vortex spheres which periodically separate off at said obstacles to produce radial and axial inhomogeneities in the form of axial concentration differences in the flow of viscous fluid;

each said primary flow obstacle having a geometrically modified area at at least one of a surface thereof and an edge thereof to induce local flows of a second order in the flow of viscous fluid passing thereover whereby said local flows of said second order are superimposed on said flows of said first order to compensate said radial and axial inhomogeneities in the viscous fluid produced by the flow of said first order.

2. A mixing device as set forth in claim 1 wherein each said primary flow obstacle is in the form of at least one of a flat, folded and curved sheet material.

3. A mixing device as set forth in claim 1 wherein said geometrically modified area is in the form of a rib disposed transversely to a respective local flow.

4. A static mixer comprising pipe defining a flow path for a low viscosity fluid; and at least one mixing device disposed within said pipe for mixing of the viscous fluid passing therethrough, said mixing device including a plurality of primary flow obstacles disposed to define constrictions therebetween for the flow of viscous fluid therethrough and to impart a flow of a first order in the flow of viscous fluid including vortex spheres which periodically separate off at said obstacles to produce radial and axial inhomogeneities in the form of axial concentration differences in the flow of viscous fluid, each said primary flow obstacle having a geometrically modified area in the form of a rib disposed transversely to a respective local flow at an edge thereof to induce local flows of a second order in the flow of viscous fluid thereat whereby said local flows of said second order are superimposed in said flow of said first order to compensate said radial and axial inhomogeneities in the viscous fluid produced by the flow of said first order.

5. A static mixer as set forth in claim 4 wherein a normal projection of said primary flow obstacles defines a cross section substantially equal to the cross section of said pipe.

6. A static mixer as set forth in claim 4 wherein said pipe is cylindrical and said primary flow obstacles form a mirror-symmetrical arrangement with a plane of symmetry in which a longitudinal axis of said pipe lies.

7. A static mixer as set forth in claim 6 wherein said primary flow obstacles include a pair of segment-like structure elements lying in one plane to form a constriction and a vane-like structure element disposed in said constriction and in crossing relation to the plane of said segment-like structure elements.

8. A static mixer as set forth in claim 4 further comprising an infeed point in said pipe for the introduction of an additive into said pipe for mixing with a viscous flow passing therethrough, said infeed point being disposed within the plane of said mixing device in said pipe.

9. A static mixer as set forth in claim 4 characterized in that the viscous fluid to be mixed is transported through said static mixer in a preferred direction with a better mixing quality being achieved with respect to said preferred direction than in an opposite direction.

10. A static mixer as set forth in claim 9 having means upstream of said mixing device relative to the flow of the viscous fluid for bringing the viscous fluid into a hydrodynamic state having at least one of turbulent flow components and an increased turbulence before passing into said mixing device for mixing thereof.

11. A static mixer comprising a pipe of predetermined cross-section defining a flow path for a low viscosity fluid; and at least one mixing device disposed within said pipe for mixing of the viscous fluid passing therethrough, said mixing device including a plurality of primary flow obstacles having a normal projection defining a cross section substantially equal to and covering said cross section of said pipe and disposed to define constrictions therebetween for the flow of viscous fluid therethrough and to impart a flow of a first order in the flow of viscous fluid including vortex spheres which periodically separate off at said obstacles to produce radial and axial inhomogeneities in the form of axial concentration differences in the flow of viscous fluid, each said primary flow obstacle having a geometrically modified area at at least one of a surface thereof and an edge thereof to induce local flows of a second order in the flow of viscous fluid thereat whereby said local flows of said second order are superimposed in said flow of said first order to compensate said radial and axial inhomogeneities in the viscous fluid produced by the flow of said first order.

12. A mixing device as set forth in claim 11 wherein each said primary flow obstacle is in the form of at least one of a flat, folded and curved sheet material.

13. A mixing device as set forth in claim 12 wherein each of said primary flow obstacles has a secondary flow obstacle thereon defining said geometrically modified area thereof.

14. A mixing device as set forth in claim 13 wherein each secondary flow obstacle is in the form of a rib disposed transversely to a respective local flow.

15. A mixing device as set forth in claim 11 wherein each said primary flow obstacle is a crossed channel structure having a plurality of sheets of metal folded in a zig-zag manner and each secondary flow obstacle is one of a rib and a rod disposed on a respective crossed channel structure.

16. A mixing device as set forth in claim 15 wherein each secondary flow obstacle is a rib having sharp edges and disposed as a folded edge of a respective primary flow obstacle.

17. A mixing device as set forth in claim 15 wherein each secondary flow obstacle has one of a wave-like edge and a toothed edge.

18. A mixing device as set forth in claim 17 wherein each secondary flow obstacle is at an edge of a respective primary flow obstacle.

* * * * *

UNITED STATES PATENT AND TRADEMARK OFFICE

CERTIFICATE OF CORRECTION

PATENT NO. : 7,316,503 B2
APPLICATION NO. : 10/832881
DATED : January 8, 2008
INVENTOR(S) : Mathys et al.

It is certified that error appears in the above-identified patent and that said Letters Patent is hereby corrected as shown below:

Column 6,
Line 24, change “viscous” to -- low viscosity --
Line 51, change “viscous” to -- low viscosity --
Line 52, change “viscous” to -- low viscosity --
Line 56, change “viscous” to -- low viscosity --
Line 60, change “viscous” to -- low viscosity --

Column 7,
Line 36, change “viscous” to -- low viscosity --
Line 38, change “viscous” to -- low viscosity --

Column 8,
Line 3, change “viscous” to -- low viscosity --
Line 7, change “viscous” to -- low viscosity --
Line 10, change “viscous” to -- low viscosity --

Signed and Sealed this

Eighth Day of July, 2008

JON W. DUDAS
*Director of the United States Patent and Trademark Office*